US012434122B2

(12) United States Patent
Cirelli

(10) Patent No.: US 12,434,122 B2
(45) Date of Patent: Oct. 7, 2025

(54) DEVICE FOR HITTING PRACTICE

(71) Applicant: Anthony Cirelli, Scottsdale, AZ (US)

(72) Inventor: Anthony Cirelli, Scottsdale, AZ (US)

( * ) Notice: Subject to any disclaimer, the term of this patent is extended or adjusted under 35 U.S.C. 154(b) by 137 days.

(21) Appl. No.: 17/972,980

(22) Filed: Oct. 25, 2022

(65) Prior Publication Data

US 2023/0131742 A1 Apr. 27, 2023

Related U.S. Application Data

(60) Provisional application No. 63/272,452, filed on Oct. 27, 2021.

(51) Int. Cl.

| | |
|---|---|
| ***A63B 69/00*** | (2006.01) |
| *A63B 69/38* | (2006.01) |
| *A63B 102/18* | (2015.01) |

(52) U.S. Cl.

CPC .. *A63B 69/0002* (2013.01); *A63B 2069/0008* (2013.01); *A63B 69/0015* (2013.01); *A63B 69/38* (2013.01); *A63B 2102/18* (2015.10)

(58) Field of Classification Search

CPC . A63B 69/0002; A63B 69/0015; A63B 69/38; A63B 2069/0008; A63B 2102/18; A63B 2102/02; A63B 2102/20; A63B 15/00; A63B 60/02; A63B 60/42; A63B 59/56; A63B 60/52; A63B 2209/00; A63B 2209/10

USPC ..... 473/422, 228, 437, 457, 519, 520, 473/564–568

See application file for complete search history.

(56) References Cited

U.S. PATENT DOCUMENTS

| | | | | |
|---|---|---|---|---|
| 5,133,551 | A * | 7/1992 | Handy | A63B 59/59 473/567 |
| 5,590,875 | A * | 1/1997 | Young | A63B 59/50 D21/725 |
| 5,676,609 | A * | 10/1997 | Møllebaek | A63B 59/50 473/564 |
| 5,803,838 | A * | 9/1998 | DeMarini | A63B 21/0088 473/437 |
| 6,280,353 | B1 * | 8/2001 | Brundage | A63B 60/46 473/519 |
| 6,875,137 | B2 * | 4/2005 | Forsythe | A63B 59/50 473/566 |
| 2015/0182771 | A1 * | 7/2015 | Sillik | A63B 69/0002 473/457 |
| 2016/0074728 | A1 * | 3/2016 | Arzola | A63B 21/0088 473/424 |
| 2017/0348575 | A1 * | 12/2017 | Umbrell | A63B 69/0002 |
| 2018/0280754 | A1 * | 10/2018 | Keough | A63B 21/151 |
| 2021/0275890 | A1 * | 9/2021 | Kim | A63B 71/0622 |

* cited by examiner

*Primary Examiner* — Nini F Legesse

(74) *Attorney, Agent, or Firm* — Snell & Wilmer L.L.P.

(57) ABSTRACT

A device for practicing hitting a ball may comprise a bat and a flag portion. The bat may comprise a bat stick comprising a bat handle and a bat barrel coupled to the bat handle; and a weight coupled to the bat barrel. The bat may comprise a rigid material. The flag portion may comprise a flag coupled to the bat barrel, wherein the flag is configured to extend from the bat barrel. The flag may comprise a flimsy material.

12 Claims, 2 Drawing Sheets

DEVICE FOR HITTING PRACTICE

CROSS-REFERENCE TO RELATED APPLICATIONS

This application is a nonprovisional of, and claims priority to and the benefit of, U.S. Provisional Patent Application No. 63/272,452, filed Oct. 27, 2021 and entitled "DEVICE FOR HITTING PRACTICE," which is hereby incorporated by reference herein.

FIELD

This application generally relates to games and athletics, and more specifically to games involving a player hitting a ball traveling toward them, and devices to improve a player's skill in such hitting.

BACKGROUND

Bat-and-ball games (e.g., baseball, cricket, or the like) require a player with a bat (or like device) to hit a ball thrown or traveling in their direction. The hitting player (i.e., a batter) must correctly time his or her swing to meet the ball in general, but also, meet the ball at a desired position in the ball's flight and in the player's swing, such that the ball is hit in a desired direction and/or a desired distance. With the possibility of different paths and speeds a ball may travel toward the batter, timing the player's swing of the bat may be challenging to achieve a desired hit.

SUMMARY OF THE DISCLOSURE

The present disclosure relates to a device for practicing hitting a ball, with which players of bat-and-ball games may practice swinging to achieve desired timing of their swings to contact a ball traveling through the air in their direction. In various embodiments, a device for practicing hitting a ball may comprise a bat and a flag portion. The bat may comprise a bat stick comprising a bat handle and a bat barrel coupled to the bat handle; and a weight coupled to the bat barrel. The bat may comprise a rigid material. The flag portion may comprise a flag coupled to the bat barrel, wherein the flag is configured to extend from the bat barrel. The flag may comprise a flimsy material. In various embodiments, the bat may comprise a barrel end of the bat, to which bat barrel is most proximate. In various embodiments, the weight may be disposed at least partially within a void in the bat barrel. In various embodiments, the void in the bat barrel may be disposed through the barrel end of the bat such that the void comprises an opening to an ambient environment through the barrel end. In various embodiments, the device may further comprise a cap coupled to the bat barrel, wherein the cap may close the opening of the void such that the weight is enclosed within the void. In various embodiments, the weight may comprise a weight shape that is complementary to a void shape of the void. In various embodiments, a length of the bat from the barrel end to a handle end opposite the barrel end is under 18 inches or under 16 inches. In various embodiments, the bat may further comprise a knob coupled to the bat handle at the handle end.

In various embodiments, a proximal end of the flag may be coupled to the bat barrel, and the flag may extend from the barrel end of the bat. In various embodiments, the flag may extend from the barrel end such that a second length from a distal end of the flag, opposite the proximal end, to a handle end of the bat is about 33 inches, wherein the handle end is opposite the barrel end of the bat. In various embodiments, the flag may be configured to extend from the barrel end in response to a centrifugal force caused by the bat being swung. In various embodiments, the flag portion may further comprise a coupling band, wherein the flag may be coupled to the bat barrel via the coupling band disposed at least partially around the bat barrel. In various embodiments, the bat barrel may comprise a recessed channel spanning at least partially around the bat barrel, wherein the coupling band may be disposed within the recessed channel. In various embodiments, the coupling band and the proximal end of the flag each may comprise a hook-and-loop material, such that the distal end of the flag may removably couple to the coupling band via the hook-and-loop material. In various embodiments, the device may comprise a plurality of flags coupled to the bat barrel spaced around the bat barrel. In various embodiments, the flag may comprise a nylon material.

In various embodiments, a kit for a device may comprise a bat comprising a bat stick comprising a bat handle and a bat barrel coupled to the handle, wherein the bat barrel may comprise a void disposed therein, wherein the bat may comprise a rigid material; a weight configured to be disposed at least partially within the void; and/or a flag configured to be coupled to the bat barrel and extend from the bat barrel, wherein the flag comprises a flimsy material. In various embodiments, the kit may further comprise a cap configured to couple to the bat barrel to close the void. In various embodiments, the device may further comprise at least one of a plurality of flags configured to be coupled to the bat barrel and extend from the bat barrel, or a plurality of weights each having a different weight, wherein the cap may be configured to removably couple to the bat barrel to allow changing of the weight disposed within the void.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. Elements with like element numbering throughout the figures are intended to be the same.

DETAILED DESCRIPTION

All ranges may include the upper and lower values, and all ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any combination and/or order and are not necessarily limited to the order or combination presented. Furthermore, any reference to singular includes plural embodiments, and any reference to more than one component or step may include a singular component or step. Also, any reference to attached, fixed, connected, or the like may include permanent, removable, temporary, partial, full, and/or any other possible attachment option. Additionally, any reference to without contact (or similar phrases) may also include reduced contact or minimal contact.

In bat-and-ball sports (e.g., baseball, cricket, tennis, or the like), the timing of the hitter's swing relative to the speed and flight path of the approaching ball is important to achieve a hit, and to achieve a hit having a desired ball flight direction and distance. Swing timing can be a difficult skill to learn, especially while a player must also learn how to discern a certain pitch type and speed at the same time. For example, it can be challenging for a hitter in baseball to work on his or her timing in swinging a bat to hit a ball, but also learn to recognize the type of pitch thrown by the pitcher (e.g., fastball, slider, curveball, changeup, etc.). The hitter may have a preoccupation with making contact between the bat and the ball (which typically dictates the success of an at-bat), which may take away from the ability to work on the swing timing (e.g., which can be more important than just making contact between the bat and ball) and/or learning to discern the pitch type, or vice versa. The device for practicing hitting a ball discussed herein allows a hitter to focus on swing timing, and/or learn to discern a pitch type, without worry of making contact between the bat and ball, while still indicating if contact between a bat and ball was or would have been made.

Figure 1A:
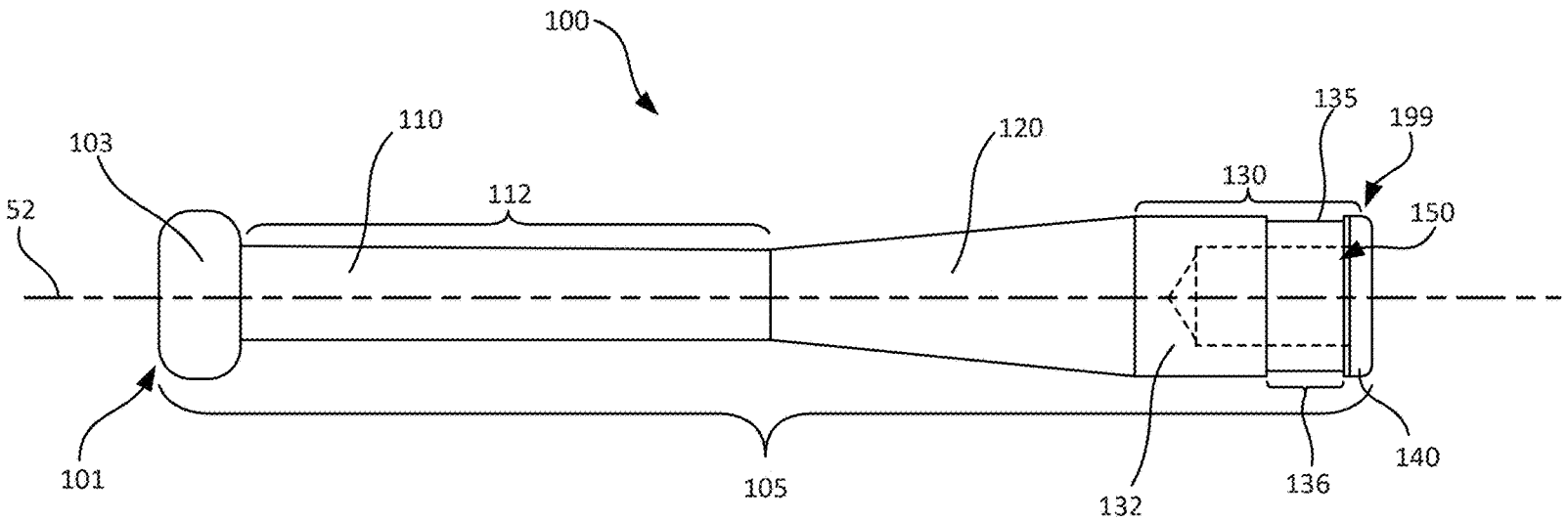
FIG. 1A illustrates a device for practicing hitting a ball, in accordance with various embodiments.
Figure 1B:
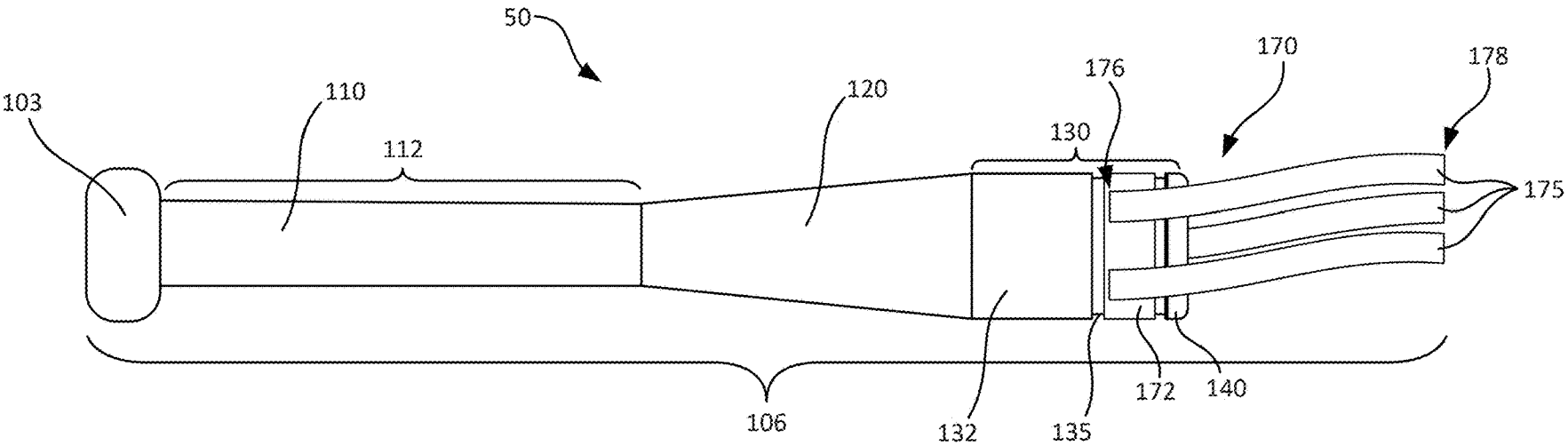
FIG. 1B illustrates a device for practicing hitting a ball comprising flags, in accordance with various embodiments.

In various embodiments, with reference to FIGS. 1A and 1B, a device 50 for practicing hitting a ball may comprise a bat system (or bat 100) and a flag portion 170. In various embodiments, bat 100 may comprise a bat grip or bat handle 110 and a bat barrel 130 coupled to bat handle 110. Bat 100 may span between a handle end 101 (which may be the end of bat 100 to which handle 110 is most proximate) and a barrel end 199 (which may be the end of bat 100 to which bat barrel 130 is most proximate). Bat handle 110 may be disposed between handle end 101 and bat barrel 130. Bat barrel 130 may be disposed between barrel end 199 and bat handle 110. In various embodiments, the cross-sectional area may be the same between bat handle 110 and bat barrel 130. In various embodiments, the cross-sectional area of bat handle 110 may be less than that of bat barrel 130 (e.g., bat handle 110 and bat barrel 130 each may comprise a generally cylindrical shape, wherein the bat handle 110 may comprise a cross-sectional diameter that is less a cross-sectional diameter of bat barrel 130). In various embodiments, bat handle 110 may be coupled to bat barrel 130 via taper portion 120. Taper portion 120 may span between bat handle 110 and bat barrel 130, and may comprise an increasing cross-sectional area along taper portion 120 from bat handle 110 to bat barrel 130. In various embodiments, taper portion 120 may be considered part of bat handle 110 or bat barrel 130.

Bat handle 110 may be configured to allow a user of device 50 to hold bat 100. Bat handle 110 may comprise any suitable size or dimensions to allow gripping of bat 100 by a user at bat handle 110. For example, bat handle 110 may comprise a cylindrical shape having a diameter between 0.5 and 2 inches, between 1 and 2 inches, or between 1 and 1.5 inches. In various embodiments, bat handle 110 may comprise a thickness or diameter of about 1 inch or about 1.2 inches (the term "about" as used in this context means plus or minus 0.2 inch). In various embodiments, bat handle 110 may comprise a handle length 112 of between 5 and 12 inches, or between 6 and 10 inches, or between 6 and 8 inches, or about 7 inches (wherein "about" in this context means plus or minus 1 inch).

In various embodiments, bat handle 110 may comprise a grip or grip tape disposed over bat handle 110 to facilitate better gripping for the player. In various embodiments, bat handle 110 may comprise ridges, recesses, checkering, texturing, or any other suitable patterning in or on the bat handle material to facilitate better gripping for the user.

In various embodiments, bat 100 may further comprise a knob 103 coupled to bat handle 100. Knob 103 may be disposed at handle end 101 of bat 100, such that bat handle 110 is disposed between knob 102 and bat barrel 130. Knob 103 may comprise a cross-sectional area greater than that of bat handle 110, such that knob 103 may be configured to mitigate the risk of a user's hands slipping off of bat handle 110.

In various embodiments, bat handle 110 may be configured to feel like the piece of athletic equipment of the sport for which a user of device 50 is practicing. For example, device 50 may be designed for use by a baseball player, so bat handle 110 may be shaped similar the handle of a baseball bat (e.g., about one inch in diameter, or no less than 15/16 inch, wherein the term "about" as used in this context means plus or minus 0.2 inch), and may comprise knob 103 such that device 50 feels similar to a baseball bat in the user's hands. As another example, device 50 may be designed for use by a cricket player, so bat handle 110 may be shaped similarly to a handle of a cricket bat (e.g., about 2.5 inches, between 1 and 3 inches, or between 2 and 3 inches thick, wherein the term "about" as used in this context means plus or minus 0.25 inch) such that device 50 feels similar to a baseball bat in the user's hands. As another example, device 50 may be designed for use by a tennis player, so bat handle 110 may be shaped similar to that of a tennis racket (e.g., the outer perimeter of the handle measuring between about 4 and 5 inches) such that device 50 feels similar to a tennis racket in the user's hands.

In various embodiments, bat barrel 130 may be a portion of bat 100 that is thicker than bat handle 110. Bat barrel 130 may comprise a barrel body 132. In various embodiments, bat barrel 130 may comprise a recess channel 135 recessed therein (or recessed into barrel body 132). Recess channel 135 channel may span at least partially around bat barrel 130 (i.e., around a circumference thereof). The cross-sectional diameter of bat barrel 130 within recess channel 135 may be smaller than another portion, or the rest of, bat barrel 130. With momentary reference to FIG. 2, bat barrel 230 (similar to bat barrel 130 in FIGS. 1A and 1B) may comprise recess channel 235 (similar to recess channel 135 in FIGS. 1A and 1B), which may be defined from the rest of bat barrel 230 by steps 234. The difference in thickness or diameter between recess channel 235 and another portion of bat barrel 230 may occur at steps 234.

In various embodiments, bat barrel 130 may comprise a void 150 disposed therein. At least one edge of void 150 may be configured to be open to an ambient environment through an opening of void 150 such that an object may be disposed within void 150 through the opening. A cap 140 may be coupled to bat barrel 130 to close the opening and enclose void 150 and/or the object inside of void 150.

The opening to void 150 may be disposed in any suitable position on bat barrel 130. In various embodiments, the void opening may be disposed through a side or sidewall of bat barrel 130, or through barrel end 199 of bat 100 and bat barrel 130. The cap used to close the void opening may couple to any suitable portion of bat barrel 130 to do so. For example, cap 140 may couple to barrel end 199 of bat barrel 130 and/or bat 100. Cap 140 may couple to bat barrel 130 in any suitable manner to enclose void 150. In various embodiments, cap 140 may comprise a complementary shape to barrel end 199 of bat barrel 130 and/or bat 100, and may be disposed over barrel end 199 to close void 150. For example, cap 140 may be disposed over barrel end 199 and coupled to bat barrel 130 via tight fit, adhesive, threading (that is, for example, cap 140 may comprise threading on an inner cap surface that is complementary to threading disposed on an outer surface at bat barrel 130 at barrel end 199), and/or the like. In various embodiments, with reference to FIG. 2, cap 240 (similar to cap 140 in FIGS. 1A and 1B), may comprise a shape complementary to the shape of void 250 (similar to void 150 in FIGS. 1A and 1B). Accordingly, cap 240 may be disposed at least partially in void 250 to close the opening of void 272. For example, cap 240 may be disposed in void 250 and coupled to bat barrel 230 therein by tight fit, an adhesive, threading (that is, for example, cap 240 may comprise threading on any outer surface that is complementary to threading disposed on a surface of void 250 at barrel end 299), and/or the like.

Figure 2:
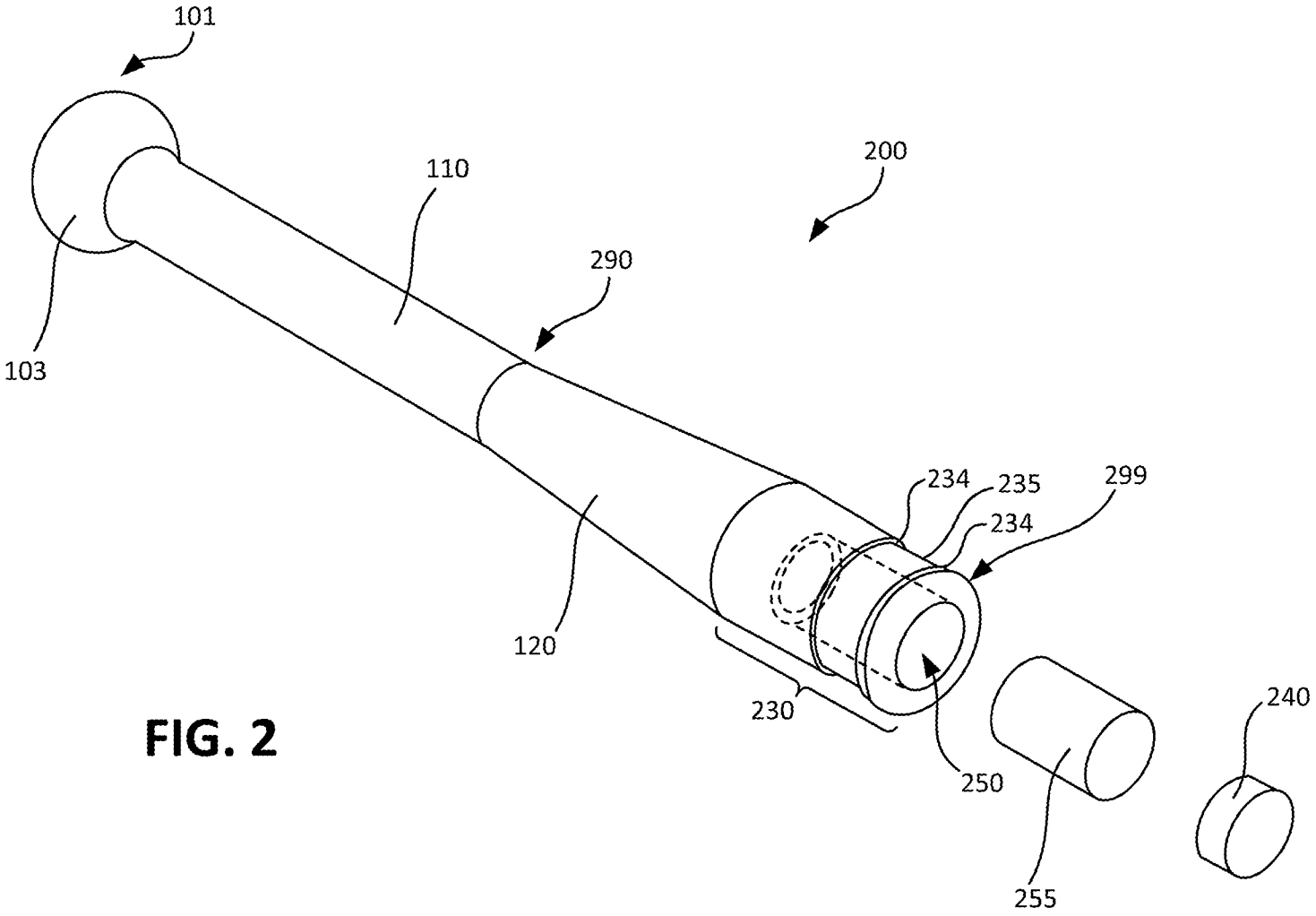
FIG. 2 illustrates an exploded view of a device for practicing hitting a ball, in accordance with various embodiments.

In various embodiments, with reference to FIG. 2, a bat 200 (similar to bat 100 in FIGS. 1A and 1B) may comprise a weight 255 disposed in void 250. Weight 255 may comprise a shape that is complementary to the shape of void 250. In various embodiments, when disposed in void 250, weight 255 may be substantially unable to move radially (i.e., toward the sides or sidewalls of void 250). Cap 240 may comprise a shape complementary to the shape of void 250 (or a shape of the opening of void 250). Cap 240 may be inserted at least partially into void 250 to enclose void 250 (e.g., with weight 255 therein). In response to weight 255 being disposed within void 250 and cap 240 being disposed in the opening of void 250 to close void 250, weight 255 may be substantially unable to move axially (i.e., along an axis 52, along which bat 200 spans).

Weight 255 may weigh a desired amount, for example, such that bat 200 will be a similar weight to that of a regulation size bat (e.g., for baseball or cricket), or such that bat 200 feels like a regulation size racket (e.g., for tennis), or the like. For example, bat 200, including weight 255 and cap 240, may weigh between 27 to 33 ounces, or about 30 ounces, 31 ounces, 32 ounces, or 33 ounces (wherein "about" as used in this context means plus or minus 1 ounce), or greater than such values (e.g., to compensate for the shorter length of bat stick 290 than regular sports equipment). In United States baseball, for major and minor leagues, weight rules for bats dictate that a bat shall weigh no more than three ounces less than the length of the bat. For example, for a length limit of 33 inches, the bat can weigh no less than 30 ounces. Thus, causing bat 200 to weigh about 30 ounces (e.g., via weight 255) makes it so the bat feels similar to a regulation bat when swung by a user. In various embodiments, weight 255 may cause bat 200 to weight less than 30 ounces (for example, for youth or little leagues), e.g., between 20 and 30 ounces, between 22 and 28 ounces, or about 25 ounces (wherein the term "about" as used in this context means plus or minus 2 ounces).

Weight 255 may comprise any suitable material to achieve the desired weight. For example, weight 255 may comprise a metal material (e.g., steel, lead, or the like), a polymer material, a ceramic material, and/or the like. The portion of bat 200 excluding weight 255 and cap 240 may be a bat stick 290. In various embodiments, weight 255 may weigh about 50% of the weight of bat stick 290 (in this context, the term "about" means plus or minus 10%). In various embodiments, weight 255 may weigh about 9 ounces or about 10 ounces (in this context, the term "about" means plus or minus 1 or 2 ounces).

With combined reference to FIGS. 1A, 1B, and 2, in various embodiments, cap 240 is removably coupled to barrel end 230. Bat 200, or system 50, may come as a kit with multiple weights 255, wherein each weight 255 may comprise a different weight, such that the different weights 255 may be selected and disposed into void 250 to achieve a desired weight of bat 200. For example, a first weight may be selected for using bat 200 to work with minor league baseball players, and a second weight may be selected for using bat 200 to work with little league baseball players, wherein the second weight is lighter than the first weight. To change the weight, the user of bat 200 may decouple cap 240 from barrel end 230, remove the weight disposed in void 250, replace such weight with another weight to achieve a different weight of bat 200, and recouple cap 240 to barrel end 230. In various embodiments, cap 240 may be fixedly coupled to bat barrel 230 such that weight 255 disposed in void 250 is not replaceable.

In various embodiments, cap 240 may be integral or monolithic with bat barrel 230 (e.g., such that bat 200 does not comprise a cap, but bat barrel 230 fully encloses weight 255). For example, the material of bat stick 290 may be molded around weight 255, or void 250 may be closed with weight 255 disposed therein by molding or applying material, joining the rest of the material comprised in bat barrel 230. In various embodiments, bat stick 290 can comprise one, integral and/or monolithic piece of material.

In various embodiments, bat stick 290 may comprise any suitable material. Bat stick 290 may comprise a rigid material. For example, bat stick 290 may comprise a metal material (e.g., aluminum, steel, or the like), a polymeric material (e.g., a plastic material, a rubber material, polyvinyl chloride, and/or the like), a ceramic material, and/or the like. In various embodiments, the cap (e.g., cap 140 or 240) may comprise any of the materials listed for bat stick 290. The cap may comprise the same or different material as the bat stick.

In various embodiments, the bat (e.g., bat 100 or 200) from the handle end to the barrel end (i.e., the entire length of bat stick 290) may comprise a stick length 105 of under 24 inches or under 18 inches. In various embodiments, stick length 105 may be between 10 inches and 18 inches, or between 12 inches and 16 inches, or between 14 inches and 16 inches. In various embodiments, stick length 105 may be about 15 or about 15.5 inches (wherein the term "about" in this context means plus or minus 0.5 inch)

In various embodiments, with reference again to FIGS. 1A and 1B, device 50 may further comprise a flag portion 170 coupled to bat 100. Flag portion 170 may comprise one or more flags 175 coupled to bat barrel 130. A proximal end 176 of flags 175 may be coupled to bat barrel 130, and a length of flags 175 may extend from bat barrel 130 and barrel end 199 (e.g., in a general direction along axis 52, along which bat 100 extends, away from bat handle 110). For example, flags 175 are configured to extend from barrel end 199 (in a direction away from bat handle 110) in response to a centrifugal force from bat 100 being swung, wherein bat handle 110 is closer to the center of the generally circular or rounded motion of the bat swing causing the centrifugal force.

Flags 175 each may comprise a length and a width. In various embodiments, the flag length may be greater than the flag width. In various embodiments, the flag width may be between 0.5 inch and 4 inches, between 1 inch and 3 inches, about 2 inches, or about 3 inches (as used in this context, "about" means plus or minus 0.5 inch). In various embodiments, the flag length may be between 5 and 40 times greater than the flag width, between 5 and 20 times greater than the flag width, between 5 and 10 times greater than the flag width, or between 6 and 9 times greater than the flag width.

In various embodiments, flags 175 may be coupled to bat barrel 130, such that the fully extended flags 175 causes device 50 to comprises a full length 106 (full length 106 comprises the length of flags 75). Full length 106 may be the length between handle end 101 of bat 100 and a distal end 178 of flags 175 (opposite the proximal end 176 of flags 175) when flags 175 are extended (e.g., via the centrifugal force discussed above). In various embodiments, full length 106 may be between 30 and 38 inches, or between 30 and 36 inches, or about 33 inches, about 34 inches, or about 36 inches (wherein the term "about" in this context means plus or minus 1 inch or 2 inches). For example, in United States baseball, the length limit for a baseball bat for major and minor leagues is 33 inches, the length limit for junior league is 34 inches, and the length limit for senior league is 36 inches. Therefore, flags 175 may be coupled to bat barrel 130 to achieve a desired full length 106 of device 50, for example, to meet one of the foregoing length limits. For example, if the user of device 50 is a player in the major or minor baseball leagues, flags 175 may have a length and may be coupled to bat barrel 130 to achieve a full length 106 of 33 inches. As another example, for use of device 50 by a cricket player, full length 106 may be 38 inches or less (e.g., between 32 and 38 inches, between 34 and 38 inches, or between 36 and 38 inches). As yet another example, for use of device 50 by a tennis player, full length 106 may be 29 inches or less (e.g., between 26 and 29 inches, between 27 and 29 inches, or between 28 and 29 inches).

Flags 175 may be coupled to bat barrel 130 in any suitable manner. For example, flag portion 170 may further comprise a coupling band 172. Coupling band 172 may be disposed at least partially around bat barrel 130 and may couple flags 175 to bat barrel 130. For example, the proximal ends 176 of flags 175 may be disposed around the outer surface of bat barrel 130, and coupling band 172 may apply a compression or clamping force on the proximal ends 176 of flags 175 to couple flags 175 to bat barrel 130 (e.g., coupling band 172 may be a rubber or elastic band). As another example, coupling band 172 may be coupled to bat barrel 130 (e.g., via adhesive, tension, or in any other suitable manner). Proximal ends 176 of flags 175 may be coupled to the outward-facing surface of coupling band 172. For example, coupling band 172 may comprise an adhesive on its outward-facing surface, and flags 175 may therefore stick to coupling band 172. As another example, coupling band 172 may comprise a hook-and-loop material on its outward-facing surface, and proximal ends 176 of flags 175 may comprise complementary hook-and-loop material, such that the proximal ends 176 of flags 175 may couple to coupling band 172 via the hook-and-loop material.

By coupling flags 175 to coupling band 172 in the exemplary manners discussed above, flags can be adjusted such that more or less of flags 175 extend from bat barrel 130 (thereby increasing or decreasing the full length 106) by moving flags 175 axially relative to coupling band 172. For example, to make full length 106 shorter, the proximal ends 176 of flags 175 may be moved toward handle end 101 such that coupling band 172 is disposed more toward a middle of flags 175. Similarly, to make full length 106 longer, the proximal ends 176 of flags 175 may be moved toward barrel end 199 such that coupling band 172 is disposed more toward the proximal ends 176 of flags 175. The full length 106 of device 50 may also be adjusted by replacing flags 175 with flags of another length. A kit for device 50 may comprise flags of different lengths to accommodate users wishing to achieve different device full lengths 106 (e.g., to provide practice for baseball players in different leagues that have different bat length rules).

In various embodiments, coupling band 172 may be disposed at least partially in recess channel 135. Coupling band 172 being disposed within recess channel 135 may mitigate the risk of coupling band 172 sliding axially along bat barrel 130, or another portion of bat 100, to an undesired position. Recess channel 135 may comprise a recess width 136 that is complementary to a width of coupling band 172.

Flags 175 may be adhered, fastened (e.g., by a nail, screw, staple, or the like), or coupled to bat 100 or coupling band 172 in any other suitable manner. For example, flags 175, or proximal ends 176 thereof, may be tied or looped around bat 100 or bat barrel 130 (e.g., in recess channel 135).

In various embodiments, flag portion 170 of device 50 may comprise one flag 175. In various embodiments, flag portion 170 of device 50 may comprise multiple flags 175. For example, flag portion 170 of device 50 may comprise two, three, or four flags 175, or any suitable number of flags 175. Flags 175 may be disposed in any suitable arrangement, such as around a circumference or perimeter of bat barrel 130. In various embodiments, flags 175 may be disposed equidistantly or unevenly around a circumference or perimeter of bat barrel 130.

In various embodiments, flags 175 may comprise a flimsy, hanging, dangling, and/or floppy material. Flags may comprise any such suitable material such as cloth, textile material, fabric, and/or the like. In various embodiments, flags 175 may comprise a light-weight fabric such as nylon, ripstop fabric, ripstop nylon, silk, and/or the like. Each flag 175, or all flags in a device 50, may weigh less than 10%, or less than 5%, or less than 2%, or less than 1% of the weight of bat 100 (or bat 200 in FIG. 2) or bat stick 290.

With reference to FIGS. 1A, 1B, and 2, device 50 allows a player to swing device 50, which feels the same or similar to the respective athletic equipment for the sport or game for which the player is practicing, and work on skills of the respective game or sport. For example, for a baseball player, device 50 may feel like a real baseball bat (e.g., because of the configuration of handle 110 and the weight added by weight 255 in bat barrel 230). Thus, a batter using device 50 may stand at a hitting position (e.g., in a batter's box), receive pitches from a pitcher or pitching machine, and swing at the pitches. Because of the significantly shorter stick length 105 of bat 100 (or of stick 290 in FIG. 2) (e.g., between 14 and 16 inches) than common lengths for baseball bats used in baseball games (e.g., about 33 inches), the user of device 50 (the batter) may swing at an approaching pitch without worrying about trying to make contact between stick 290 and the ball (e.g., because bat stick 290 is not long enough to practically attempt to hit a baseball pitch therewith). Also, with a catcher catching the pitches during such practice, the catcher does not have to worry about the batter making contact with the ball, which would suddenly change the direction of the ball (causing a risk that the catcher may fail to catch the ball and be hit by the pitch). Therefore, stick length 105 of bat 200 may provide for safer catching by a catcher during practice, and/or may allow device 50 to have a longer lifespan since bat 100 will not be getting damaged by contact with the ball.

Also, continuing with the baseball example, because the user of device 50 (the batter) knows that he or she will not make contact with the ball, the batter does not have to worry about making contact, and can instead focus on swing timing and other hitting mechanics (balance, rotation, finish, stride length, swing plane, etc.). As the batter swings device 50, flags 175 extend from bat barrel 130 to an appropriate length (for baseball usage, for example, about 33 inches) from the centrifugal force resulting from the swing of device 50. The batter can feel if flags 175 make contact with the approaching ball, thus providing feedback that the batter's swing made contact with the ball (e.g., also indicating that the batter's swing timing is at or near a desired level). Such contact may indicate that the batter's swing with a real baseball bat would have also made contact with the bat (e.g., because of the similarities between device designed for baseball and a real baseball bat). However, because flags 175 comprise lightweight, flimsy material, flags 175 may have little or no effect on the flight path of the ball in response to contacting the ball. Thus, a catcher assisting with the practice may catch the ball without increased risk of being hit by a pitch that has deflected off of a solid object.

Further, another benefit of the user of device 50 (the batter) not having to worry about trying to make contact between stick 290 and the ball, is that the batter can also focus on learning to discern what type of pitch is being thrown (with the option of simultaneously working on the swing and swing timing). Thus, the batter may swing at pitches, but apply more focus on watching the pitcher's grip on the ball, windup, follow-through, and release to learn to discern different pitches with different ball flights and speeds (e.g., fastball, slider, curveball, changeup, etc.). Learning to discern the type of pitch may aid a batter in developing swing timing skills, because swing timing may depend on the pitch type of the approaching ball (and the associated ball flight and speed). Further, contact between flags 175 and the ball may indicate improved pitch discernment and swing timing.

Yet another benefit of device 50, is that a pitcher may practice pitching with a batter in the batting box or batting position (e.g., in baseball or cricket). Having a batter in a batting position can greatly change the view of a target for a pitcher, as some batters stand further or closer to the plate or wicket. Thus, a batter may practice swinging at pitches using device 50, without disrupting the pitcher's pitch flight and speed, so the pitcher may be able to work on placing (i.e., spotting) and shaping pitches at the same time.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A device for practicing hitting a ball, comprising:

a bat, comprising:

a bat stick, spanning between a handle end and a barrel end, comprising a bat handle and a bat barrel coupled to the bat handle, wherein the bat stick comprises a stick length between the handle end and the barrel end of less than 18 inches; and a weight coupled to the bat barrel, wherein the bat stick comprises a rigid material; and a flag portion comprising a flag coupled to the bat barrel, wherein the flag is configured to extend from the bat barrel, wherein the flag comprises a flimsy material, wherein a proximal end of the flag is coupled to the bat barrel, and the flag extends from the barrel end of the bat stick, wherein the flag portion further comprises a coupling band to which the flag is coupled, wherein the flag is coupled to the bat barrel via the coupling band disposed at least partially around the bat barrel, and wherein the bat barrel comprises a recessed channel spanning at least partially around a circumference of the bat barrel, wherein the coupling band is disposed within the recessed channel.

2. The device of claim 1, wherein the weight is disposed at least partially within a void in the bat barrel.

3. The device of claim 2, wherein the void in the bat barrel is disposed through the barrel end of the bat such that the void comprises an opening to an ambient environment through the barrel end.

4. The device of claim 3, further comprising a cap coupled to the bat barrel, wherein the cap closes the opening of the void such that the weight is enclosed within the void.

5. The device of claim 2, wherein the weight comprises a weight shape that is complementary to a void shape of the void.

6. The device of claim 1, wherein the bat further comprises a knob coupled to the bat handle at the handle end.

7. The device of claim 1, wherein the stick length is under 16 inches.

8. The device of claim 1, wherein the flag extends from the barrel end such that a full length from a distal end of the flag, opposite the proximal end, to the handle end of the bat stick is about 33 inches.

9. The device of claim 8, wherein the flag is configured to extend from the barrel end in response to a centrifugal force caused by the bat being swung.

10. The device of claim 1, wherein the coupling band and the proximal end of the flag each comprise a hook-and-loop material, such that the proximal end of the flag removably couples to the coupling band via the hook-and-loop material.

11. The device of claim 1, comprising a plurality of flags coupled to the bat barrel spaced around the bat barrel.

12. The device of claim 1, wherein the flag comprises a nylon material.

* * * * *